US005119758A

United States Patent [19]

Inoue et al.

[11] Patent Number: 5,119,758

[45] Date of Patent: Jun. 9, 1992

[54] DEVELOPING PROCESS

[75] Inventors: Masahide Inoue, Taima; Koichi Tsuyama, Kobe; Yoshitake Shimizu, Kyoto, all of Japan

[73] Assignee: Mita Industrial Co., Ltd., Osaka, Japan

[21] Appl. No.: 412,124

[22] Filed: Sep. 25, 1989

[30] Foreign Application Priority Data

Sep. 27, 1988 [JP] Japan ..... 63-239683

[51] Int. Cl.[5] ..... G03G 15/09

[52] U.S. Cl. ..... 118/658; 355/251

[58] Field of Search ..... 355/246, 251, 253; 118/657, 658

[56] References Cited

U.S. PATENT DOCUMENTS

| | | | |
|---|---|---|---|
| 4,342,283 | 8/1982 | Terashima | 355/246 X |
| 4,357,901 | 11/1982 | Fagen, Jr. et al. | 355/246 X |
| 4,364,659 | 12/1982 | Noda | 355/246 X |
| 4,576,465 | 3/1986 | Fushida et al. | 355/246 |
| 4,592,645 | 6/1986 | Kanai et al. | 355/246 X |
| 4,717,999 | 1/1988 | Kaneko | 355/246 X |

FOREIGN PATENT DOCUMENTS

| | | | |
|---|---|---|---|
| 0102038 | 3/1984 | European Pat. Off. | 355/253 |
| 0210466 | 11/1984 | Japan | 355/251 |
| 0075686 | 4/1987 | Japan | 355/246 |

*Primary Examiner*—R. L. Moses

[57] ABSTRACT

Disclosed is a process for developing an electrostatic latent image, which comprises forming a magnetic brush of a two-component type developer comprising a toner and a magnetic carrier on a developing sleeve and bringing the magnetic brush into sliding contact with a photosensitive drum, wherein a spike-cutting plate is arranged along the developing sleeve to adjust the spike length of the magnetic brush, a detecting mechanism is arranged in a development apparatus to detect the concentration of the toner by measuring the permeability of the developer, the magnetic carrier used has a saturation magnetization not higher than 50 emu/g but not lower than 40 emu/g, and the ratio (do/dl) of the distance (do) between the spike-cutting plate and the developing sleeve to the distance (dl) between the photosensitive drum and the developing sleeve is set in the range of from 0.80 to 0.85, whereby the toner concentration is detected by the detecting mechanism and the development is carried out at a predetermined toner concentration.

7 Claims, 2 Drawing Sheets

DEVELOPING PROCESS

BACKGROUND OF THE INVENTION (1) Field of the Invention

The present invention relates to a process for developing an electrostatic latent image in an electrophotographic copying machine or the like. More particularly, the present invention relates to a developing process in which an excellent image can be formed while carrying out detection and control of the toner concentration effectively.

(2) Description of the Related Art

In an electrophotographic copying machine, an electrostatic latent image is formed by carrying out electric charging and imagewise light exposure on a photosensitive drum, a magnetic brush of a two-component type developer comprising a toner and a magnetic carrier is formed on a developing sleeve, and the magnetic brush is brought in sliding contact with the photosensitive drum to effect visualization (development) of the electrostatic latent image.

The magnetic carrier used for the two-component type developer is divided into a type having a relatively small value of the specific resistance, such as iron powder or lowly resistant ferrite, and a type having a relatively large value of the specific resistance of high-resistance ferrite etc. The former type has a good reproducibility for the solid portion but is poor in the reproducibility of fine lines, while the latter type has a good reproducibility for fine lines but the image density in the solid portion is poor. Thus, each type has merits and demerits.

Japanese Unexamined Patent Publication No. 60-87373 proposes a development system for obtaining an image having a sufficient resolving power, a sufficient reproducibility of letters and a sufficient density by using a carrier having a specific insulation resistance higher than $10^{12}\Omega$-cm, in which the ratio of the distance between a developing roll and a regulating plate to the distance between the developing roll and a photosensitive drum is adjusted to from 0.85 to 1.05 and a carrier having a saturation magnetization of 5 to 40 emu/g is used.

Recently, a copying machine is often used not only in a well-air-conditioned office but also in a place in which environmental changes are violent, for example, a factory. Accordingly, a development system capable of providing a stable image irrespectively of environmental changes is desired, and for example, environmental changes are coped with by a combination of a toner concentration sensor and a temperature-humidity sensor.

However, if a carrier having a low magnetic force, for example, a carrier having a saturation magnetization of 5 to 40 emu/g, as proposed in the above-mentioned prior art, is used, the sensitivity of the sensor is reduced and it becomes impossible to control the toner concentration. Alternatively, even if the control is possible, the control accuracy is reduced and various troubles take place.

SUMMARY OF THE INVENTION

It is therefore a primary object of the present invention to provide a developing process in which the toner concentration can be precisely controlled and the resolving power, the reproducibility of letters (fine lines) and the density of the solid portion of a formed image can be improved.

More specifically, in accordance with the present invention, there is provided a process for developing an electrostatic latent image, which comprises forming a magnetic brush of a two-component type developer comprising a toner and a magnetic carrier on a developing sleeve and bringing the magnetic brush into sliding contact with a photosensitive drum, wherein a spike-cutting plate is arranged along the developing sleeve to adjust the spike length of the magnetic brush, a detecting mechanism is arranged in a development apparatus to detect the concentration of the toner by measuring the permeability of the developer, the magnetic carrier used has a saturation magnetization not higher than 50 emu/g but not lower than 40 emu/g, and the ratio (do/d1) of the distance (do) between the spike-cutting plate and the developing sleeve to the distance (d1) between the photosensitive drum and the developing sleeve is set in the range of from 0.80 to 0.85, whereby the toner concentration is detected by the detecting mechanism and the development is carried out at a predetermined toner concentration.

A magnetic carrier having a specific insulation resistance of $10^9$ to $10^{11}\Omega$-cm is preferably used in the developing process of the present invention.

DETAILED DESCRIPTION OF THE PREFERRED EMBODIMENTS

Figure 1:
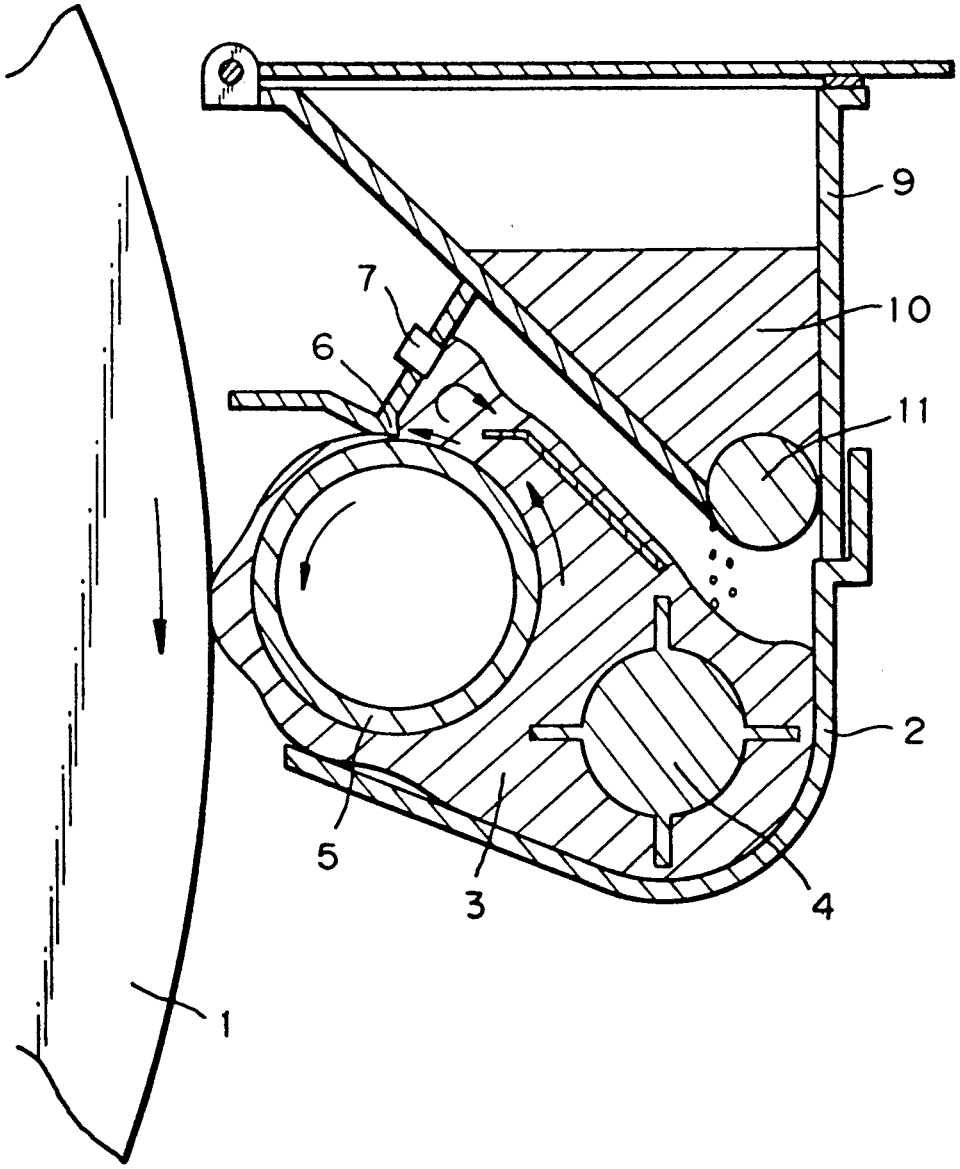
FIG. 1 is a diagram illustrating an example of the developing apparatus of the present invention.

In the present invention, the toner concentration is detected by measuring the permeability of the developer, and a detecting mechanism (a toner concentration sensor) is arranged for controlling the toner concentration.

In order to precisely detect the toner concentration, it is important that a magnetic carrier having a saturation magnetization not higher than 50 emu/g but not lower than 40 emu/g, preferably from 42 to 48 emu/g, should be used. If the saturation magnetization of the used magnetic carrier is lower than 40 emu/g, the permeability of the carrier is reduced and the gradient of the sensitivity curve of the sensor becomes small, with the result that it becomes difficult to precisely detect and control the toner concentration. On the other hand, if the saturation magnetization of the magnetic carrier exceeds 50 emu/g, the binding force among carrier particles is increased and the spike of the magnetic brush becomes hard, and the migration becomes bad and scraping of the toner in the developing zone is caused.

In the present invention, in order to obtain a high image quality, it is important that the clearance should be set so that the ratio (do/d1) of the distance (do) between the spike-cutting plate and the developing sleeve to the distance (d1) between the photosensitive drum and the developing sleeve is set in the range of from 0.80 to 0.85, especially from 0.80 to 0.84. If the do/d1 ratio is controlled with the above-mentioned range, strong compression of the developer in the developing zone can be avoided, and disturbance of the visualized toner image or reduction of the image density by rubbing or the like can be prevented. If the do/d1 ratio is higher than 0.85 strong compression of the developer is caused on the developing zone and dropping or scraping of the toner image is caused. In order to prevent this disadvantage, as proposed in the above-mentioned prior art, the saturation magnetization of the carrier should be controlled below 40 emu/g to weaken the binding force among carrier particles. In this case, however, precise detection of the toner concentration becomes difficult. On the other hand, if the do/d1 ratio is lower than 0.80, the developer is coarsened in the developing zone and a sufficient density cannot be obtained for the solid black portion. In order to eliminate this disadvantage, the specific insulation resistance should be reduced, and in this case, the reproducibility of letters or fine lines is degraded.

It is preferred that the specific insulation resistance of the magnetic carrier be $10^9$ to $10^{11}\Omega$-cm, especially in the order of $10^{10}\Omega$-cm. If the specific insulation resistance of the magnetic carrier is lower than $10^9\Omega$-cm, the reproducibility of letters or fine lines is reduced, and if the specific insulation resistance is higher than $10^{11}\Omega$-cm, the image density of the solid portion is often reduced.

According to the present invention, by the synergistic effect of the above-mentioned actions, the resolving power, the reproducibility of letters or fine lines and the density of the solid portion can be highly improved at the development while precisely detecting the concentration of the toner in the developer.

An embodiment of the developing process of the present invention will now be described with reference to the accompanying drawings.

Referring to FIG. 1 illustrating an example of the apparatus for use in carrying out the developing process of the present invention, an electrostatic latent image formed on a photosensitive drum 1 is subjected to the magnetic brush development with a developer 3 comprising a toner and a carrier, which is contained in a developing device 2. More particularly, a stirring roller 4 for uniformalizing the developer 3 is arranged within the developing device 2. A developing sleeve 5 is arranged to confront the photosensitive drum 1 with a certain distance d1 therebetween. This developing sleeve 5 is constructed by a magnet and the like, and the carrier in the developer 3 is formed into a chain of magnetic brushes, while the toner is stuck to the carrier by frictional charging. In order to smoothly develop the above-mentioned electrostatic latent image formed on the photosensitive drum 1, the length do of the magnetic brushes is regulated by a regulating plate 6, and by bringing the magnetic brushes into contact with the photosensitive drum 1, the toner is transferred onto the electrostatic image on the photosensitive drum 1 to effect the development of the electrostatic latent image.

At a predetermined position falling in contact with the flowing developer 3 in the developing device 2, there is disposed a magnetic sensor 7 for detecting the toner concentration in the developer 3 by utilizing the phenomenon that the permeability of the developer is in direct proportion to the occupancy ratio of the carrier as the magnetic material in the developer 3 and is in inverse proportion to the toner concentration. In the magnetic sensor 7, by utilizing the fact that the frequency put out from an oscillator coil arranged within the magnetic sensor 7 changes while depending on the permeability of the developer 3, this change is taken out as the output voltage and the toner concentration in the developer 3 is displayed as the numerical value of the voltage. In order to prevent reduction of the toner concentration in the developer 3 with advance of the development and subsequent reduction of the image density, when reduction of the toner concentration in the developer 3 below a predetermined value, that is, reduction of the permeability below a predetermined value, is detected by the sensor 7, a supply toner 10 contained in a hopper 9 is fed by a toner supply roller 11 and the development is carried out while adjusting the toner concentration in the developer 3 within the predetermined range.

Figure 2:
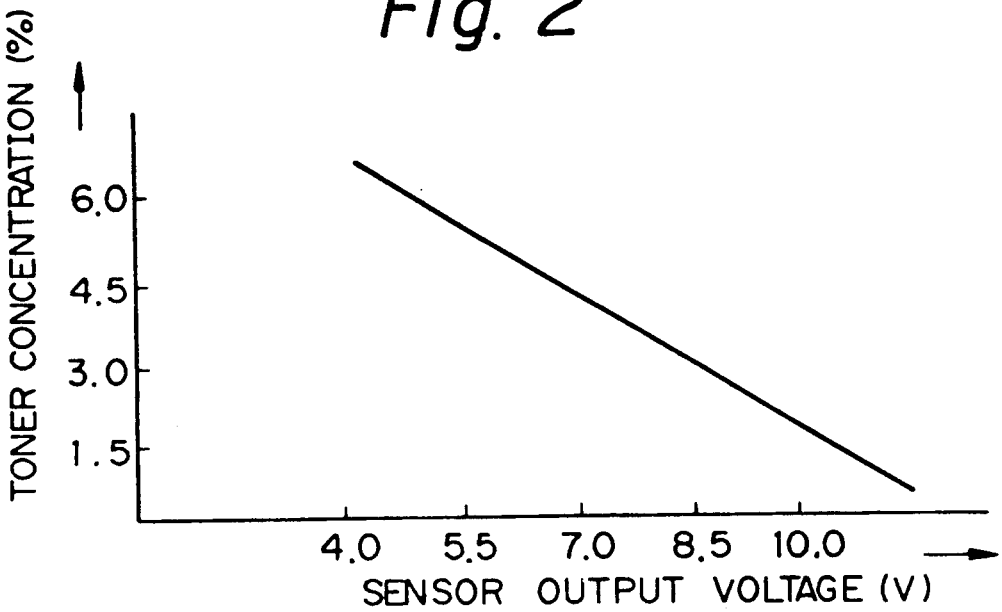
FIG. 2 is a diagram illustrating the relation between the toner concentration in the developer and the output voltage of the magnetic sensor.

FIG. 2 illustrates the relation between the toner concentration in the developer 3 and the output voltage of the magnetic sensor 7, and from FIG. 2, it is understood that the output voltage of the sensor is in inverse proportion to the toner concentration in the developer but is in direct proportion to the carrier concentration in the developer.

Figure 3:
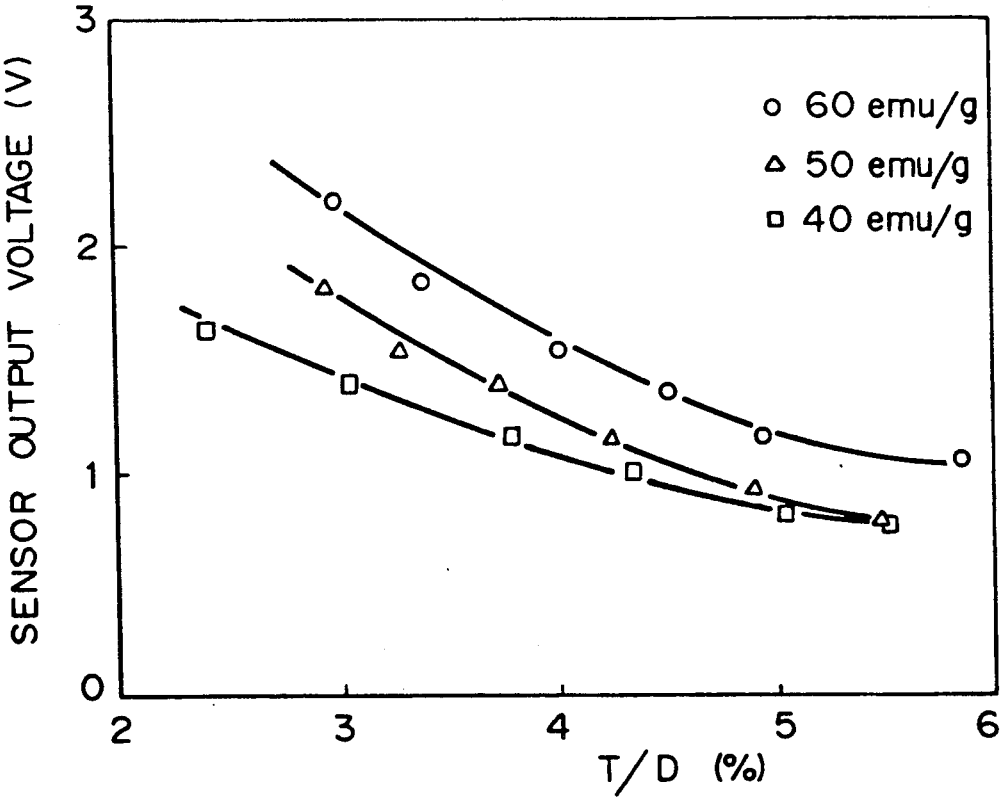
FIG. 3 is a diagram illustrating the relation between the toner concentration and the output voltage in developers differing in the saturation magnetization of the carrier.

In FIG. 3, the relation between the toner concentration and the output voltage of the magnetic sensor is plotted while changing the saturation magnetization of the carrier in the developer. From FIG. 3, it is understood that if the saturation magnetization of the carrier is lower than 40 emu/g, the gradient of the output voltage to the change of the toner concentration becomes small and precise detection of the toner concentration becomes difficult.

In the present invention, a magnetic carrier having the values of the saturation magnetization and specific insulation resistance included within the above-mentioned ranges is used. The carrier having these characteristics is easily available as high-resistance ferrite. For example, a product formed by coating the surface of ferrite with an electrically insulating resin such as an acrylic resin is easily available. A ferrite carrier having a larger particle size is likely to form an image having a better quality, and it is preferred that hte particle size of the ferrite carrier be 50 to 200 μm, especially 80 to 150 μm.

A toner prepared by incorporating a colorant, a charge controlling agent and an offset preventing agent into a binder resin (fixing resin) and adjusting the particle size of 5 to 20 μm, especially 7 to 15 μm, can be used. It is preferred that the conductivity of the toner be at least $10^{-12}$ s/cm.

The toner concentration in the two-component type developer is changed according to the kinds of the carrier and toner and the environmental conditions, but it is generally preferred that the toner concentration be 1 to 10% by weight, especially 2 to 5% by weight.

In the developing process of the present invention, the do/d1 ratio is set within the above-mentioned range. It is most preferred that the spike-cutting distance do be 0.85 to 0.95 mm and the development distance d1 be 1.05 to 1.15 mm.

A bias voltage is applied between the photosensitive drum and the developing sleeve, and it is generally preferred that the bias voltage be 150 to 300 V, especially 170 to 250 V. The polarity of the bias voltage should be the same as the polarity of the charge of the photosensitive drum.

In the present invention, a known photosensitive material for the electrophotography, such a selenium photosensitive material, an amorphous silicon photosensitive material, a CdS photosensitive material or an organic photoconductive photosensitive material, can be used as the photosensitive material.

According to the present invention, by using a carrier having a specific saturation magnetization and further a specific insulation resistance and carrying out the magnetic brush development with a two-component type developer while controlling the do/d1 ratio within the above-mentioned range, the resolving power, the reproducibility of letters or fine lines and the density of the solid portion are highly improved while precisely detecting the toner concentration in the developer, and a toner image having a high image quality can be stably formed even if the developer is used for a long time or environmental conditions are changed.

The present invention will now be described in detail with reference to the following example that by no means limits the present invention.

EXAMPLE

A composition formed by mixing and dispersing 100 parts by weight of a styrene-acrylic copolymer as the binder resin, 9 parts by weight of carbon black as the colorant, 1 part by weight of a dye composed of a chromium complex as the charge controlling agent and 2 parts by weight of a low-molecular-weight polypropylene as the offset preventing agent and melt-kneading the mixture was cooled, pulverized and classified to form a toner having an average particle size of 11 μm.

Ten developers were prepared by mixing the toner with a carrier composed of ferrite particles differing in the characteristics while adjusting the toner concentration to 3 to 4%.

With respect to each developer, the copying test of 10000 sheets was carried out under a surface potential of 800 V in the photosensitive drum and a bias voltage of 200 V in a modified model of electrophotographic copying machine DC-3285 (supplied by Mita Industrial Company Limited) while changing the ratio of the distance between the brush spike-cutting plate and the developing sleeve to the distance between the photosensitive drum and the developing sleeve.

The obtained results are shown in Table 1.

TABLE 1

| Run No. | Characteristics of Carrier: saturation magnetization (emu/g) | Characteristics of Carrier: specific insulation resistance (Ω-cm) | Brush Spike-Cutting Ratio $d_0/d_1$ | Toner Concentration (% by weight) | Image Density of Solid Portion | Fog Density | Resolving Power (line/mm) |
|---|---|---|---|---|---|---|---|
| 1 | 42 | $1 \times 10^{10}$ | 0.84 | 3.20 | 1.35 | 0.001 | 7 |
| 2 | 48 | $8 \times 10^{9}$ | 0.81 | 3.05 | 1.34 | 0.001 | 7 |
| 3 | 45 | $3 \times 10^{10}$ | 0.82 | 2.97 | 1.32 | 0.001 | 7 |
| 4 | 35 | $2 \times 10^{10}$ | 0.82 | 3.80 | 1.35 | 0.004 | 4 |
| 5 | 60 | $4 \times 10^{10}$ | 0.82 | 3.15 | 1.34 | 0.002 | 5~6 |
| 6 | 45 | $2 \times 10^{10}$ | 0.90 | 3.25 | 1.37 | 0.005 | 4 |
| 7 | 48 | $8 \times 10^{9}$ | 0.75 | 3.23 | 1.11 | 0.003 | 4 |
| 8 | 45 | $3 \times 10^{12}$ | 0.84 | 3.21 | 1.21 | 0.003 | 5~6 |
| 9 | 48 | $8 \times 10^{8}$ | 0.82 | 3.15 | 1.43 | 0.012 | 4 |
| 10 | 35 | $2 \times 10^{2}$ | 0.90 | 3.25 | 1.32 | 0.003 | 5~6 |

In each of runs 1, 2 and 3, a sharp image having a high resolving power was obtained without fogging, and the density of the solid portion of the formed image was high.

In run 4, since the spike of the brush was too soft, the image was deformed in the portion of letters or lines and the formed image was not satisfactory in the reproducibility of fine lines and the resolving power. Furthermore, while the copying operation was continued, the toner concentration sensor was erroneously actuated and precise control of the toner concentration was impossible.

In run 5, the brush eared too much and a scraping effect was produced, and blurring was caused in the portions of letters or fine lines.

In run 6, the developer was compressed too strongly in the developing zone and sweeping lines were formed in the solid portion by the magnetic brushes while blurring was caused in the portion of letters.

In run 7, the magnetic brushes were too coarse in the developing zone and the density of the solid portion was insufficient.

In run 8, the density of the solid portion was not elevated to a satisfactory level because of the edge effect and some fogging was observed.

In run 9, the density of the solid portion was excessively high and fogging was conspicuous.

In run 10, the density of the solid portion was satisfactory but probably because of too strong compression of the developer in the developing zone, the line image was biased and the rear end of the image was not reproduced. Furthermore, in the continuous copying operation, the toner concentration sensor was not sufficiently actuated and scattering of the toner or fogging of the image was caused.

We claim:

1. A process for developing electrostatic latent image by a developing mechanism comprising a housing for storing therein a developer comprising a mixture of a magnetic carrier and a toner, a developing sleeve having magnets arranged in the interior thereof to attract the developer to the outer circumferential surface thereof and deliver the developer, a spike-cutting plate for adjusting the spike height of the developer to be delivered to a developing zone and, adhering to the developing sleeve and a detecting mechanism for detecting the concentration of the toner in the developer, said process comprising detecting the toner concentration by bringing the developer, which has been cut by the spike-cutting plate, prior to delivery to the developing zone, but which has been isolated from the developing sleeve and has been flowing, into contact with the toner concentration-detecting mechanism provided with a permeability sensor, the magnetic carrier having a saturation magnetization not higher than 50 emu/g but not lower than 40 emu/g and a specific insulation resistance of $10^9$ to $10^{11}$Ω-cm, the ratio of the distance between the spike-cutting plate and the developing sleeve to the distance between a photosensitive drum and the developing sleeve being set in the range of from 0.80 to 0.85.

2. The process of claim 1 wherein the magnetic carrier has a saturation magnetization of from 42 emu/g to 48 emu/g.

3. The process of claim 1 wherein the spike-cutting plate is located a distance from said developing sleeve which is in the range of from 0.80 to 0.84 times the distance between the photosensitive drum and the developing sleeve.

4. The process of claim 1 wherein said magnetic carrier comprises ferrite particles having a particle size in the range of from 80 to 150 microns and wherein the toner has a particle size in the range of from 7 to 15 microns.

5. The process of claim 4 wherein the toner has a conductivity of at least $10^{-12}$ s/cm.

6. The process of claim 5 wherein said toner comprises a colorant, a charge controlling agent and an offset preventing agent in a binder resin.

7. The process of claim 1 wherein the spike-cutting plate is located at a distance of from 0.85 to 0.95 mm from said developing sleeve and the distance between the photosensitive drum and the developing sleeve is from 1.05 to 1.15 mm.

* * * * *